United States Patent [19]

Blumenthal et al.

[11] 4,094,154

[45] June 13, 1978

[54] ROOF PROP APPARATUS AND METHOD FOR LONGWALL MINING

[75] Inventors: Gunter Blumenthal, Westerholt; Karlheinz Bohnes; Peter Marr, both of Bochum, all of Germany

[73] Assignee: Bochumer Eisenhutte Heintzmann GmbH & Co., Bochum, Germany

[21] Appl. No.: 748,912

[22] Filed: Dec. 9, 1976

[30] Foreign Application Priority Data

Oct. 15, 1976 Germany ..... 2646562

[51] Int. Cl.[2] ..... E21D 15/44

[52] U.S. Cl. ..... 61/45 D

[58] Field of Search ..... 61/45 D; 299/31-33; 248/357; 91/170 MP

[56] References Cited

FOREIGN PATENT DOCUMENTS

| | | | |
|---|---|---|---|
| 1,272,031 | 8/1961 | France | 61/45 D |
| 1,308,267 | 9/1962 | France | 61/45 D |
| 1,241,389 | 6/1967 | Germany | 61/45 D |
| 275,949 | 5/1971 | U.S.S.R. | 61/45 D |

*Primary Examiner*—Dennis L. Taylor
*Attorney, Agent, or Firm*—Michael J. Striker

[57] ABSTRACT

In longwall mining wherein a mine roof is normally supported by a succession of arches each in turn supported at one mine wall on a respective leg, a plurality of vertically expensible holders are pressed up against a plurality of respective adjacent arches with a common first beam, and legs of the thus-supported arches are removed so that the mine wall can be worked at this location. For advancing along the longwall all of the holders except the holder at one end of the row of holders are pressed upwardly against the respective arches with a second beam. The leg of the arch of the end holder is replaced and then the first beam is dropped down away from the row of holders. The end holder is then displaced to the opposite end of the row and the first beam is advanced toward this other end and the end holder is positioned under the arch immediately adjacent the other end. Then all of these holders including the end holder are pressed upwardly by the first beam against the respective arches and the second beam is dropped downward and displaced toward the other end. The leg of the newly supported arch can then be removed and the mine wall can be worked where this leg has been removed. Each of these beams is vertically displaceable relative to a lower beam by means of hydraulic cylinders and further hydraulic cylinders interconnect the lower beams for longitudinal stepping of the entire assembly.

19 Claims, 4 Drawing Figures

ROOF PROP APPARATUS AND METHOD FOR LONGWALL MINING

BACKGROUND OF THE INVENTION

This invention relates to a method of and an apparatus for longwall mining. More particularly this invention concerns an apparatus for supporting the roof of a mine while a longwall face cut into one wall of the mine is worked.

Longwall mining is normally used for the recovery of coal. In such a mining method a horizontal drift or mine extends along the seam to be worked. The roof of this mine is propped up with supports normally standing on legs at the mine walls, that is at the vertical sides of the mine or drift. In order to work the longwall face it is therefore necessary to remove the legs of the roof props at the working location.

Typically, this requires secondary struts to be braced between the part of the prop normally termed the arch that engages the mine roof, so as to allow the leg on one side to be removed. Such struts are usually complicated screw or hydraulic arrangements which must be manually and paintakingly emplaced one-by-one. Furthermore, the use of such secondary struts frequently results in damage to the arches so that subsequent remounting of the legs thereon proves rather difficult.

Not only must the roof arches be supported at locations spaced somewhat from the longwall face being worked in the side wall of the mine, but it is then necessary to move a considerable amount of equipment about in the mine in order to work the face. The use of a plurality of separate struts as described above greatly complicates maneuvering within the mine and even further slows down the longwall working of the face.

SUMMARY OF THE INVENTION

It is therefore an object of the present invention to provide an improved method of and apparatus for longwall mining.

Another object is the provision of an apparatus which serves to support the roof-engaging parts or arches of the mine props during working of a longwall face at one side wall of the mine.

These objects are attained according to the present invention in a roof-propping apparatus having a pair of similar frames, one shorter than the other, in which each have an elongated upper part juxtaposable with the arches and a lower part supported on the mine floor. These parts extend parallel next to each other and a plurality of discrete holders are engageable between these upper parts and the arches, one such holder for each arch. Means is provided for expanding these holders and bracing them between either of the upper parts and the respective arches, and means is provided for displacing the frames relative to each other in the direction of elongation of the upper parts. Finally, a support platform is mounted on one of the frames and is adapted and constructed to supporting mining equipment and the drive for the various devices.

With such an arrangement it is therefore possible to press each of a row of holders upwardly against a plurality of respective adjacent arches with a common first beam constituting the upper part of one of the frames. The legs of these thus-supported arches can be removed then and the mine wall worked where the legs have been removed. All of the holders which are being pressed against respective arches whose legs have been removed can then also be pressed against the respective arches by a second beam constituting the upper part of the other frame, with the exception of the holder at one end of the row of holders being pressed against the arches. The leg of the arch of this end holder is replaced and the first beam is then dropped down away from the row of supports so that the end holder is no longer supported by the beams and can then be moved longitudinally to the other end of the row of holders. The first beam, which has been dropped down away from the holders, is then moved toward the other end of the row and the moved end holder is positioned under the arch immediately adjacent this other end. Then all of the holders including the end holder are again pressed against respective arches with the first beam. It is then possible to drop down and displace the second beam toward the other end of the row of holders and remove the leg of the arch which is now newly supported by the end holder. The mine wall can then be worked where this last-mentioned leg has been removed. In this manner it is possible for the apparatus to slowly advance or retreat along the mine, moving in steps corresponding to the distance between adjacent roof-supporting arches.

In accordance with another feature of this invention, the upper beam of one of the frames is constituted by a pair of transversely spaced-apart parallel beams which flank a beam constituting the upper part of the other frame. This double beam is longer by a distance equal to approximately the longitudinal distance between adjacent arches than the other beam, and is normally used to press the holders against the arches. The other shorter single beam serves merely to hold the assembly in place during advance of the double beam.

According to further features of this invention each of these frames includes, as mentioned above, an upper beam, and in addition a lower beam connected via uprights to the upper beam for relative vertical displacement of the two beams. Hydraulic cylinders lying in a common plane for both frames are provided extending between the upper beams and the lower beams for independent vertical displacement of each upper beam relative to its respective lower beam. Furthermore, each of the holders is constituted as a square-section two-part vertically telescoping housing inside of which is provided a fluid cylinder serving to displace the upper housing part, which is shaped to fit snugly against the arch it is used to support, against this arch.

With the system according to the present invention the holders are pressed continuously against their respective arches with approximately the same force during the time when the longwall face is worked. There is no shifting of struts and the like tending to damage the arches or loosen them, so that it is possible to work relatively rapidly along the longwall face, at least the supporting of the arches will not add considerable time to the otherwise arduous mining operation. What is more it is possible to support a good portion of the mining equipment on this apparatus which advances or retreats along the mine approximately at the location on which the longwall face is being worked, so that once again the efficiency of the operation is greatly increased and, therefore, extraction costs are reduced. What is more the even distribution of the supporting force avoids local overloading of the support stratum or overlying rock so that the possibility of subsequent cave-ins is considerably reduced.

In accordance with yet another feature of this invention the platform for supporting the mining equipment and drive machinery for the various elements of the apparatus is mounted on the shorter frame which is received between the double beams of the longer frame. Thus when the longer frame is braced between mine roof and floor it is possible for a double-acting hydraulic cylinder extending longitudinally between the two frames to advance the single-beam frame and the machinery-supporting platform carried thereby. This platform is pivotal about a horizontal axis constituted by a rod extending between two of the uprights of the single-beam platform and is of T-shape, L-shape, or F-shape. Thus, as the two-part frame arrangement steps its way along the mine it automatically carries with it the necessary equipment.

Each of the holders has a curved upper surface shaped to fit the corresponding portion of the arch. Moreover, each of these upper surfaces is provided with a covering or the like giving it a high coefficient of friction so that these holders need not be clamped to the arches, but can merely push against them, with friction preventing mutual slipping. In addition, each of the frames which are generally planar, is oriented in a plane extending outwardly at an angle from a vertical plane through the center of the tunnel. This maximizes the space for working the longwall face under the apparatus.

According to yet another feature of the present invention the double beam is provided with a pair of longitudinally extending parallel rods constituting a guide rail along which is displaceable a trolley. A turntable on this trolley has an arm whose end can be raised and lowered and, on rotation of the turntable, pivoted about a vertical axis. Means is provided for raising and lowering the end of the arm and for grabbing with the end of the arm a holder. Furthermore, a drive is connected via an endless chain to this trolley so that it is possible to operate this arrangement to pick a holder off the upstream end of the double beam and move it down to the downstream end thereof. To this end each holder is provided with valve means and connector means that allow it to be disconnected from the other holders and depressurized in order that it can be dropped down from the respective arch, picked up, and moved to the opposite end of the row of holders which press respective arches against the mine roof. The gripping is achieved in accordance with this invention by forming a pocket or downwardly open recess on one side of each holder and providing the arm with an end portion or projection which is snugly engageable upwardly in this pocket or recess so that the respective holder can readily be lifted.

The frames according to this invention are provided with a plurality of laterally extending arms operated by respective cylinders and carrying at their ends roof props which serve to hold up the roof above the longwall cut. Thus, the device is virtually self-contained, capable of holding up not only the mine roof, but the roof above the cut as it moves along the mine or drift. These props are provided on the longer of the two frames, spaced apart by a distance equal to half the step normally taken by the frames, which is itself equal to the distance between adjoining roof-propping arches.

The novel features which are considered as characteristic for the invention are set forth in particular in the appended claims. The invention itself, however, both as to its construction and its method of operation, together with additional objects and advantages thereof will be best understood from the following description of a specific embodiment when read in connection with the accompanying drawings.

DESCRIPTION OF A PREFERRED EMBODIMENT

Figure 1:
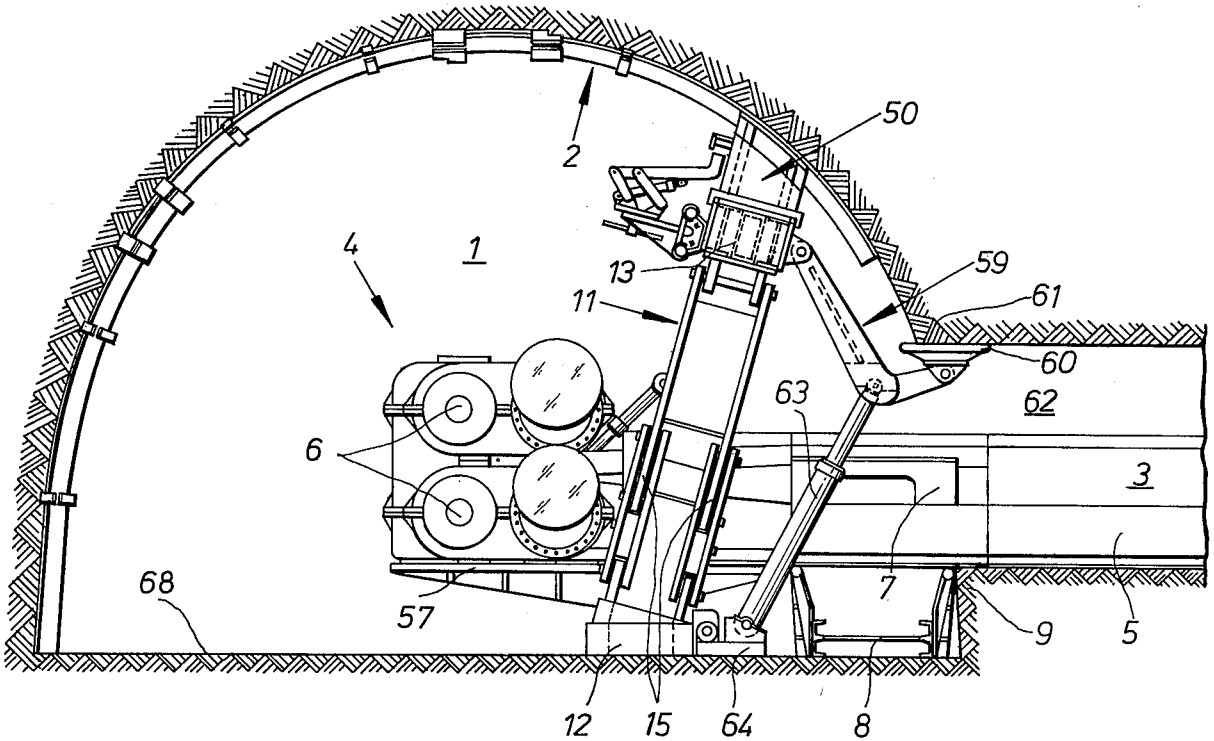
FIG. 1 is a vertical section through a mine using an apparatus carrying out the method according to this invention.
Figure 2:
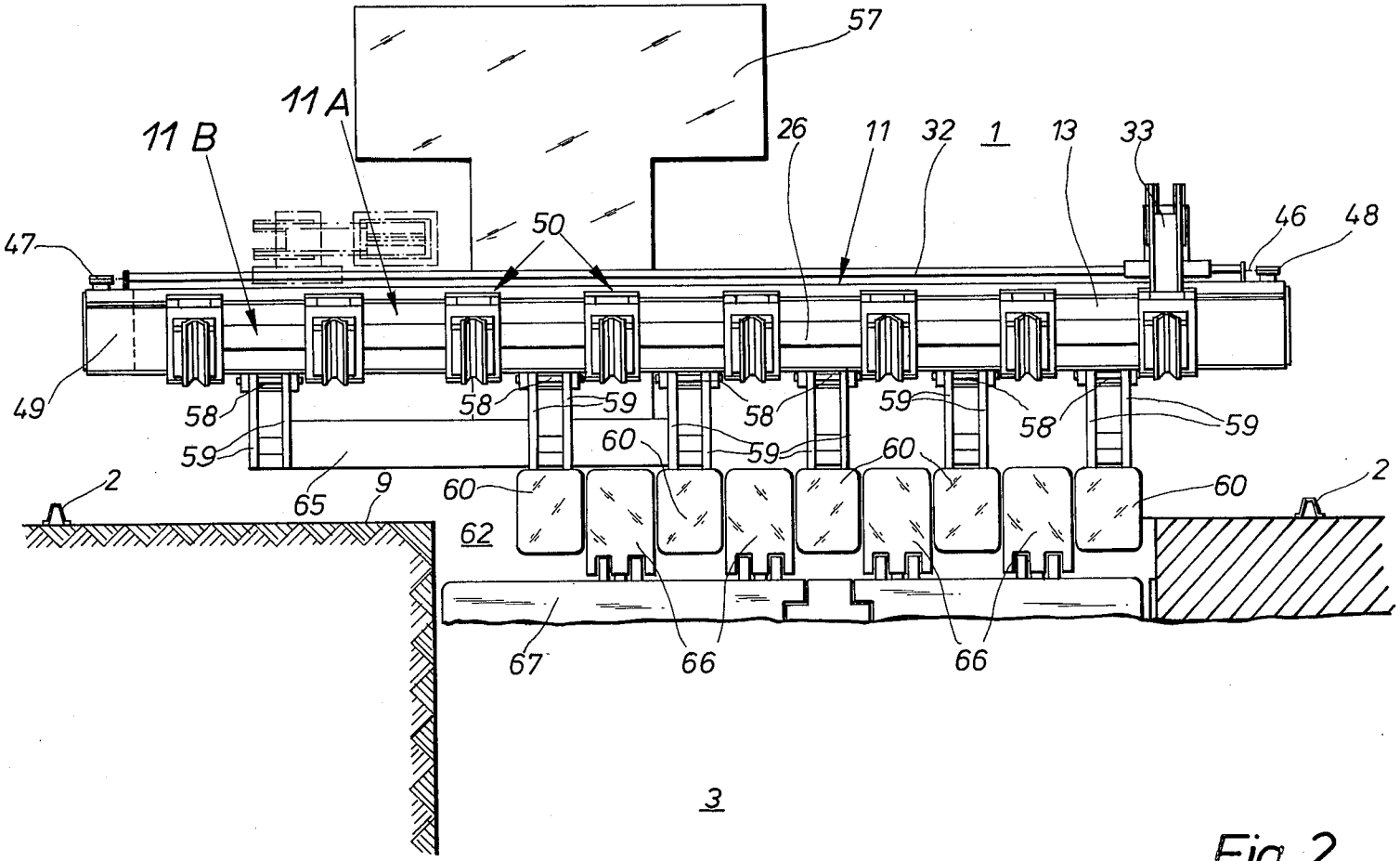
FIG. 2 is a top view of the apparatus shown in FIG. 1.

As shown in FIGS. 1 and 2, a mine 1 has its roof supported by arcuate U-section arches 2. In this mine 1 a longwall face cut 3 is being worked. To this end a drive head 4 operates a conveyor 5 whose drive motor is shown at 6. The conveyor 5 has a transfer device 7 which feeds to a face conveyor 8 which runs along the side wall or longwall 9 of the mine 1.

Each of the arches 2 is supported by a pair of legs 10 which must be removed adjacent the cut 3.

To this end the arches 2 are held against the roof of the mine 1 by means of a double frame 11 having a relatively long frame 11A and a relatively short frame 11B. The frame 11A comprises upper and lower double beams 12 and 13 formed virtually identically and separated by hydraulic cylinders 14 constituting uprights. In addition at each end the two beams 12 and 13 are connected together by rocker linkages 15.

Figure 4:
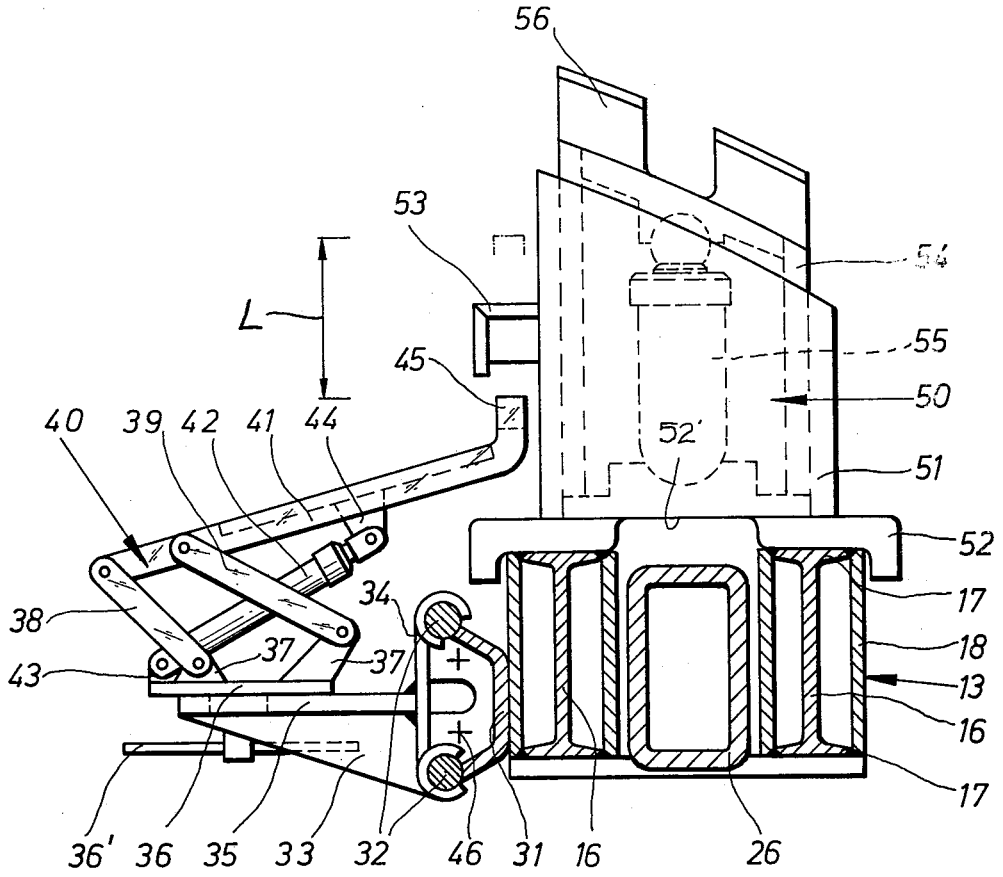
FIG. 4 is a section taken along line IV — IV of FIG. 3.

As shown in FIG. 4 the beam 13 which is identical to the beam 12, comprises a pair of I-beams 16 having flanges 17 joined together by plate 18 to form extremely rigid box girders. At its ends the upper beam 13 is provided with further stiffening plates 19.

The end sections 20 of the lower double beam 12 are provided with bases 21 forming a pair of pivots for two shorter links 22 and 23 pivoted at their other ends on a relatively long link or connecting rod 24. The upper end of each of these rods or links 24, which moves in a plane perpendicular to the girders 12 and 13 is pivoted at 25 on the corresponding end of the upper beam 13. Thus as the double-acting rams 14 expand and contract vertically perfect parallelism is insured between the upper double beam 13 and the lower double beam 12.

The frame 11B comprises a rectangular-section upper beam 26 and a rectangular section lower beam 27. These beams 26 and 27 are embraced between the double beams of the upper and lower beams 13 and 12 as shown with respect to beams 26 and 13 in FIG. 4. Telescoping square-sectioned uprights 28 are provided between the beams 26 and 27 and double-acting rams 29 are provided within these uprights 28. The rams 14 and 29 lie substantially in the same plane which is inclined as shown in FIG. 1 to a plane running vertically through the center of the tunnel 1.

Rams 30 are provided which extend parallel to the longitudinal axes of the beams 12, 13, 26 and 27 and are connected at one end to the frames 11A and at the other end to the frame 11B. These rams 30 are double-acting and allow the one frame 11A to move relative to the other frame 11B. Under normal operating conditions, as described below, the one frame is braced between the roof and the floor of the mine while the other frame is slid along the floor of the mine. It is also noted that the frame 11B is substantially shorter than the frame 11A, normally by a distance D at least equal to the spacing between a pair of adjacent arches 2.

As best shown in FIG. 4 the upper beam 13 is provided with a plurality of U-shaped holders 31 carrying a pair of vertically spaced parallel and horizontally extending rods 32 constituting a guide rail for a trolley 34 carrying a support 33 having a horizontal plate 35 on which is rotatable a turntable 36 about a vertical axis by means of a handle 36'. This turntable 36 has a pair of pivots 37 on it on which are pivoted the lower ends of a pair of links 38 and 39 of another rocker linkage 40 having an elongated upper arm 41 and provided with a double-acting hydraulic ram engaging between lug 43 of the turntable 36 and a lug 44 on the arm 41. The upper outer end of this arm 41 is bent up as shown at 45.

As also shown in FIG. 2 an endless chain 46 spanned over sheaves 47 and 48 on the upper beam 13 is displaceable by means of a hydraulic motor 49 carried at one end of this beam 13 so as to displace holders 50 along the upper beam 13.

Each of these holders 50 as best shown in FIG. 4 comprises a square-section outer housing 51 having a downwardly open U-shaped shoe 52 that engages over the beam 13, allowing the holder 50 to move longitudinally along the beam 13 and the beam 26 but preventing it from sliding transversely relative to the beam 13. In addition the shoe 52 is formed at its center with a cutout 52' in which can engage beam 26 to also prevent this holder 50 from moving transversely relative to the beam 26 when it is being pressed thereby against a respective arch 2 as will be described below.

The square-section outer housing 51 has a pocket or recess 53 on its side turned away from the mine wall. The upper end 45 of the linkage 40 can fit within this recess 53 so that lifting of this upper end 45 through a distance L can lift the entire holder 50 off the beam 13 or the beam 26.

Figure 3:
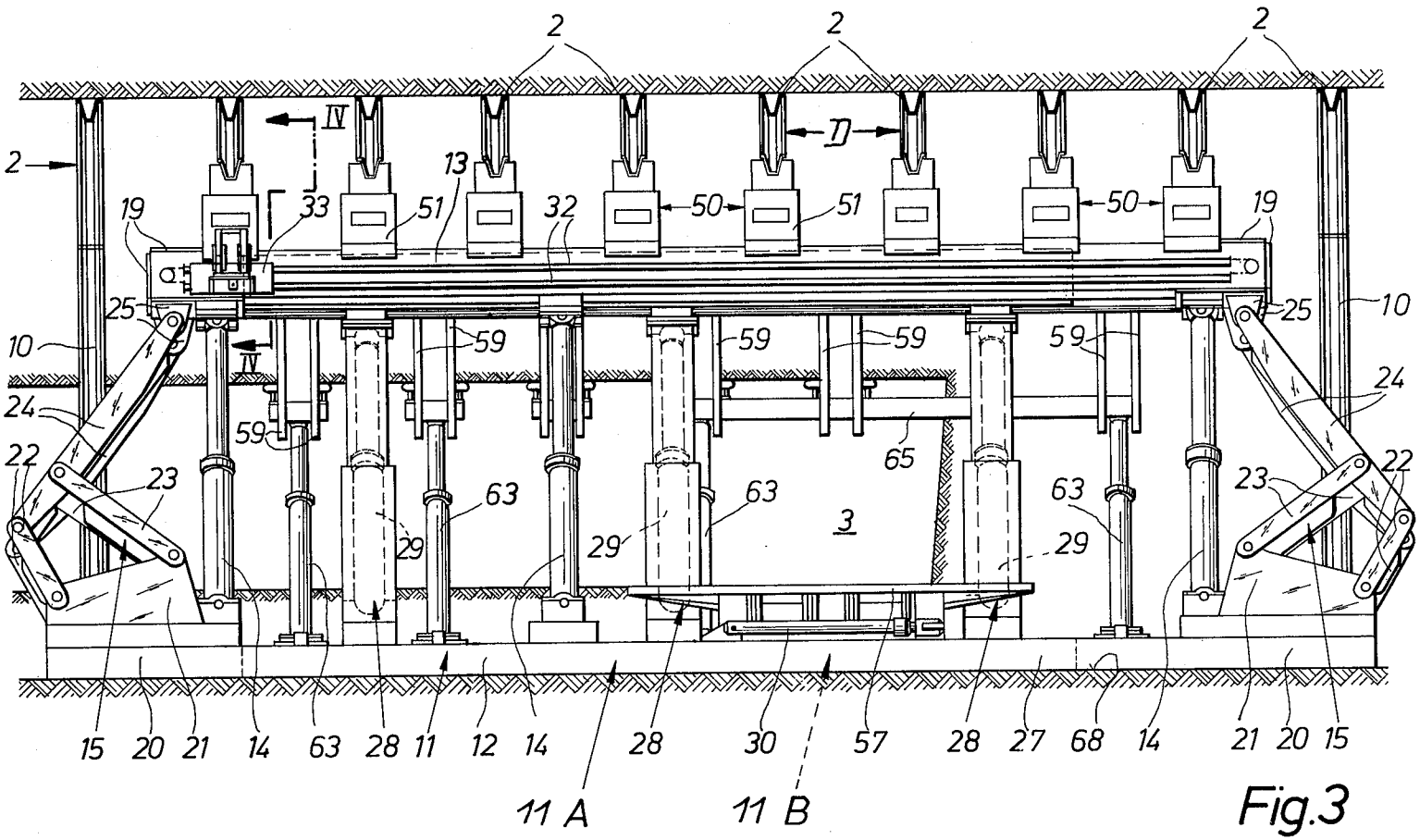
FIG. 3 is a vertical longitudinal section through the mine showing the apparatus of FIG. 1 in side view.

In addition the outer housing 51 is telescoped around an inner square-section housing 54, with a fluid ram 55 between them. The upper end 56 of this inner member 54 is inclined, like the top surface of the member 51 and grooved so as to mate well as shown in FIG. 3 with an arch 2. In addition, this upper part 56 has a friction coating that greatly increases the frictional contact. This friction coating can constitute a layer of tough elastomeric material that prevents slipping of the part 56 relative to an arch 2. As particularly shown in FIGS. 2 and 3 the region between two adjacent uprights 28 above the cylinders 30 is filled with a T-shaped platform 57 which is pivotal about an axis extending longitudinally of the frame 11. This platform 11 serves to mount the drive 6 for the conveyor 5 in the cut 3 as well as the face-working machine such as a coal plow movable along the face.

In addition, the upper beam 13 is provided on its side turned toward the cut 3 with a plurality of pivots 58 on which are mounted bent arms 59 carrying at their outer ends prop plates 60 which can be pressed against the mine roof 61 over the cut 3. This prevents the mine roof 61 from falling down into the region 62 at the cut 3. Each of these arms 59 has a respective cylinder 63 pivoted at one end to the elbow between the two sections of the arm 59 and at the other end on a pivot 64 on the lower beam 12. In the region of the drive-support platform 57 there are no such cylinders 63, but a beam 65 is provided interconnecting the prop plates 60 in order to hold up the roof 61 at this location.

FIG. 2 also shows how between the prop plate 60 there are provided further prop plates 66 which are carried on the frame 67 supporting the roof over the cut 3.

In use the frame 11B assumes the position shown in FIGS. 2 and 3 relatively far back along the unit 11A. In this position the hydraulic rams 29 in the uprights 28 are not pressurized so that it is possible to move the unit 11B relative to the unit 11A along the frame 11. Thus the beams 26 and 27 will slide along between the respective double beams 12 and 13.

Once the frame 11B is pulled fully to the left as shown in FIG. 3 it will underlie all but that support 50 at the far right on the beam 13. Thereupon the cylinders 28 are pressurized so as to push the upper beam 26 up into the notches 52', so that all but the end holder 50 are supported by the beam 26.

Thereupon the leg 10 for the arch 2 on the end holder 50 is replaced and the trolley 33 is slid down and the upper end 45 slipped into the pocket 53 of this end holder 50. The cylinders 14 are then all relaxed so as to drop the upper beam 13 down and away from the roof of the mine leaving all but the end holder 50 supported on the beam 26 and in tight engagement with the respective arches 2. The end holder 50 is now picked up off the dropped beam 13, the arm 36 is swung around so as to move the holder into the position shown in dot-dash lines in FIG. 2, and the drive 49 is actuated so as to move the end holder 50 all the way down along the beam 13 to the opposite end thereof. At the same time the cylinders 30 are operated so as to slide the entire frame 11A with the support 57 longitudinally through a step of a length D so that the downstream end of the beam 13 underlies the next arch 2.

the turntable 36 is then rotated through 90 degrees again and the end holder 50 is positioned under the new arch 2. Thereupon the rams 14 are pressurized in order to press all of these holders 50 up against the arches 2. The leg 10 of the newly supported arch 2 can then be removed and the longwall face can be worked at this location.

It is noted that during such stepping the cylinders 63 are relaxed and the plates 60 are dropped down away from the roof 61. Since the plates 60 only have a longitudinal length equal to half of the distance D and since the regions between them are supported by the plates 66 it is possible for the plates 60 to again be pressed against the roof 61 after such stepping. It is possible that the cut region will cave in at the upstream end, but this is of no consequence in most situations as the seam has been fully worked. Also, it is frequently standard practice to fill in this region with tailings and the like.

The cylinders 55 inside the holders 50 are all provided with over-pressure valves so that none of these holders 50 exerts a pressure on the respective arch that is sufficient to damage it. The pressure on all of the arches is spread out over the floor 68 of the mine 1 through a long enough distance to insure that a local sinking-in or the like is unlikely. Furthermore, since the linkages 15 insure perfect parallelism between the beams 12 and 13, as the pivots 25 will move only perpendicular to the beam 12, an extremely exact guiding and centering of the arches 2 is insured. The holders 50 may be connected together serially by snap-couplings and hoses so that it is merely necessary to unplug the endmost holder 50 from its neighbor and the plug it into its neighbor at the opposite end of the row during connection. Periodically, it will of course be necessary to reconnect a source of fluid under pressure to one of the centermost holders 50 in order to insure pressurization of these holders 50. It is also noted that some play is normally left in the pivots of the linkages 15 in order to insure perfect parallelism between the beams 12 and 13, as some of these pivots will inherently move in arcuate paths.

It will be understood that each of the elements described above, or two or more together, may also find a useful application in other types of longwall mining differing from the types described above.

While the invention has been illustrated and described as embodied in a roof support for longwall mining operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A roof-propping apparatus for longwall mining wherein the mine roof is supported by a succession of arches each in turn supported at one mine wall by a respective leg, said apparatus comprising: a pair of similar frames each having an elongated upper part juxtaposable with said arches and a lower part supported on the mine floor, said upper parts extending parallel next to each other; a plurality of discrete holders each engageable between said upper parts and said arches; means for expanding said holders and bracing said holders between either of said upper parts and respective arches; means for displacing said frames relative to each other in the direction of elongation of said upper parts; and a support platform mounted on one of said frames adapted and constructed to support mining equipment.

2. The apparatus defined in claim 1 wherein each of said frames is provided with means for displacing its upper part vertically relative to its lower part, whereby said holders cna be braced against said arches by said upper parts.

3. The apparatus defined in claim 2 wherein said upper part of one of said frames is an elongated beam, said upper part of the other frame being a pair of elongated beams flanking and parallel to said beam of said one frame.

4. The apparatus defined in claim 2 wherein each of said frames includes a plurality of telescoping uprights between each of sid upper parts and the respective lower part.

5. The apparatus defined in claim 4 wherein each of said frames is provided with means including linkages for maintaining the respective upper part parallel to the respective lower part.

6. The apparatus defined in claim 2 wherein said means for displacing said upper parts vertically includes a plurality of hydraulic rams all lying in substantially the same plane and extending between said lower parts and the respective upper parts.

7. The apparatus defined in claim 1 wherein each of said frames lies generally in a plane inclined toward said mine wall away from a vertical plane extending longitudinally through the respective mine.

8. The apparatus defined in claim 1 wherein said platform is raisable and lowerable.

9. The apparatus defined in claim 8 wherein said platform is adapted to support a drive motor.

10. The apparatus defined in claim 1 wherein said holders each have a two-part vertically telescoping housing and are each provided with said means for expanding.

11. The apparatus defined in claim 10, further comprising means for displacing said holders longitudinally of said upper parts.

12. The apparatus defined in claim 11 wherein said means for displacing said holders includes a guide rail extending longitudinally the full length of one of said upper parts, a trolley longitudinally displaceable along said rail, and a linked pickup arm engageable with said holders.

13. The apparatus defined in claim 12, further comprising drive means on said one upper part having a chain for longitudinally displacing said trolley along said rail.

14. The apparatus defined in claim 12 wherein said guide rail comprises a pair of mutually fixed and parallel rods fixed to said one upper part.

15. The apparatus defined in claim 1, further comprising a plurality of roof props projecting laterally from said frames and means for pressing said props against the roof of a longwall cut.

16. The apparatus defined in claim 15 wherein said props are spaced longitudinally apart by a distance equal to approximately half the distance between adjacent holders.

17. The apparatus defined in claim 16 wherein each of said props includes a bent arm pivoted on one of said frames and a plate carried on said arm and engageable with said roof of said cut.

18. The apparatus defined in claim 17, further comprising a connecting beam extending between adjacent plates in the region of said platform.

19. In a method of longwall mining wherein a mine roof is normally supported by a succession of arches each in turn supported at one mine wall on a respective leg, the improvement comprising the steps of sequentially:

(a) pressing each of a row of holders upwardly against a plurality of respective adjacent arches with a common first beam;

(b) removing the legs of the arches of said plurality pressed by said first beam and working said mine wall where these legs have been removed;

(c) pressing all of said holders of said row except the holder at one end of said row upwardly against the respective arches with a second beam;

(d) replacing the leg of the arch of the end holder of step (c);

(e) dropping said first beam down away from said row of holders and displacing the end holder of step (c) to the other end of said row;

(f) advancing said first beam toward said other end of said row and positioning said end holder under the arch immediately adjacent said other end;

(g) pressing all of said holders including said end holder against the respective arches with said first beam;

(h) dropping down and displacing said second beam toward said other end and removing the leg of said arch of step (f); and (i) working said mine wall where the leg of the arch of step (f) has been removed.

* * * * *